United States Patent [19]

Janthur

[11] Patent Number: 4,958,600

[45] Date of Patent: Sep. 25, 1990

[54] LIQUID COOLING SYSTEM FOR A SUPERCHARGED INTERNAL COMBUSTION ENGINE

[75] Inventor: Ingo Janthur, Russelsheim, Fed. Rep. of Germany

[73] Assignee: General Motors Corporation, Detroit, Mich.

[21] Appl. No.: 474,286

[22] Filed: Feb. 2, 1990

[30] Foreign Application Priority Data

Feb. 17, 1989 [DE] Fed. Rep. of Germany ..... 3904801

[51] Int. Cl.[5] ..... F01P 7/14

[52] U.S. Cl. ..... 123/41.31; 60/605.3

[58] Field of Search ..... 123/41.21, 41.31, 559.1, 123/563; 60/605.3

[56] References Cited

U.S. PATENT DOCUMENTS 4,561,387 12/1985 Körkemeier et al. ..... 60/605.3

4,829,939 5/1989 Veenemans et al. ..... 123/41.31

*Primary Examiner*—Noah P. Kamen

*Attorney, Agent, or Firm*—Robert J. Outland

[57] ABSTRACT

A liquid cooling system for an internal combustion engine charged by a turbosupercharger has forced circulation cooling of the engine and turbosupercharger. To cool the turbosupercharger after the internal combustion engine has been switched off the turbosupercharger inlet pipe contains a check valve and a return flow pipe to an expansion tank is split into branch pipes, a first pipe entering the expansion tank above the cooling liquid level and a second pipe entering the expansion tank below the cooling liquid level and having a check valve. Upon switching off the engine, the cooling liquid in the turbosupercharger is evaporated by residual heat and discharges the cooling liquid into the expansion tank in a cyclic, thrust-like process.

2 Claims, 3 Drawing Sheets

LIQUID COOLING SYSTEM FOR A SUPERCHARGED INTERNAL COMBUSTION ENGINE

TECHNICAL FIELD

This invention pertains to a liquid cooling system for an internal combustion engine which is charged by a turbosupercharger, in which the turbosupercharger is connected to the cooling circuit of the internal combustion engine via an inlet flow pipe and a return flow pipe, and during operation of the internal combustion engine this results in forced circulation cooling, and the cooling system has an equalizing vessel or expansion tank for the cooling liquid.

BACKGROUND

Turbosuperchargers with liquid-cooled bearing housings are employed to an increasing extent in turbosupercharged internal combustion engines to prevent coking of the oil in the bearing of the turbosupercharger. While the cooling liquid is circulated by a pump during operation of the engine, the liquid must be circulated by a suitable thermosiphon action or a follow-up electric pump after the internal combustion engine has been switched off so as to avoid temperature build-up due to retained heat in the turbosupercharger. However, the thermosiphon action to be obtained is often difficult due to unfavorable drops in temperature; electric follow-up liquid pumps require temperature-resistant materials, electric wiring and a switch relay and are thus very expensive.

From DE-OS No. 34 07 521 is known a liquid cooling system of the type mentioned, in which, in addition to the cooling circuit for the internal combustion engine, another cooling circuit is provided for the turbosupercharger. The inlet flow pipe of the turbosupercharger is connected to the outlet of a radiator attached to the cooling circuit for the internal combustion engine. The return flow pipe of the turbosupercharger flows into the inlet flow pipe of the internal combustion engine just before the circulating pump which is attached to the cooling circuit of the internal combustion engine. The inlet flow pipe of the turbosupercharger is connected via a branch pipe to a heat exchanger that is geodetically situated higher, and another branch pipe connects the return flow pipe of the turbosupercharger to the heat exchanger. An expansion tank for the temperature variable volume of cooling liquid is employed as the heat exchanger.

The expansion tank is filled up to a certain level, and the two branch pipes flow into the expansion tank below this level. A one-way or check valve is mounted in the branch pipe that connects the expansion tank to the return flow pipe of the turbosupercharger, which allows flow through this branch pipe only toward the expansion tank. In lieu of the check valve, a remote-controllable magnetic valve can also be installed in the branch pipe.

During operation of the internal combustion engine, cooling liquid flows through the first cooling circuit which is attached to the internal combustion engine as well as the second cooling circuit which is attached to the turbosupercharger. The check valve makes it impossible for the cooling liquid to flow from the expansion tank through the branch pipe which is attached to the return flow pipe of the turbosupercharger bypassing the turbosupercharger in its return flow pipe.

After the internal combustion engine has been shut off, and thus the circulating pump as well, a pressure equilibrium occurs in the entire cooling circuit of the internal combustion engine, whereby the forced circulation cooling is ended. The hot cooling liquid of the turbosupercharger can then rise up to the expansion tank through its return flow pipe and through the branch pipe that is attached to it. The cooling liquid cools off in the expansion tank and flows back through the inlet flow pipe to the turbosupercharger. Thus, after the internal combustion engine is shut off, the turbosupercharger is cooled exclusively through thermosiphon action with the disadvantage initially described.

SUMMARY OF THE INVENTION

A purpose of the present invention is to provide a liquid cooling system of the type mentioned, which ensures that the turbosupercharger is cooled after switching off the internal combustion engine without the aid of a follow-up circulating pump with an essentially improved efficiency compared to the efficiency in the thermosiphon flow.

The purpose is accomplished in that the inlet flow pipe of the turbosupercharger contains a check valve, and the return flow pipe of the turbosupercharger is split into branch pipes, a first pipe flowing into the expansion tank above the cooling liquid level as well as a second pipe flowing into the expansion tank below the cooling liquid and containing a check valve.

During operation of an internal combustion engine having a preferred embodiment of liquid cooling system in accordance with the invention, cooling liquid is conveyed by a cooling liquid pump through an inlet flow pipe of the turbosupercharger and its bearing housing where its bearing is cooled. From there, it flows back through the return flow pipe of the turbosupercharger and reaches that position of the cooling system where the heated cooling liquid is cooled off so as to be resupplied to the cooling process.

However, when the internal combustion engine is switched off, the retained heat of the turbosupercharger heats the cooling liquid in the bearing up to the boiling point. Vapor is thereby produced in the bearing, which forces the liquid into the return flow pipe and from there through the first pipe which ends above the cooling liquid level as well as through the second pipe which ends below the cooling liquid level and into the expansion tank. For this purpose, the return flow pipe must be made small enough that the vapor, which expands rapidly can force before itself the cooling liquid columns in the return flow pipe and the first and second pipes.

After this process, the cooling liquid flows from the return flow pipe back into the turbosupercharger or it condenses the vapor in the return flow pipe. However, the liquid level in the return flow pipe is now lower because of the amount of cooling liquid already fed into the expansion tank, since this cooling liquid cannot flow back either through the first pipe ending above the cooling liquid level or through the second pipe ending below the cooling liquid level due to the check valve. Thus, a pressure difference p is produced at the check valve located in the inlet flow pipe of the turbosupercharger due to the different liquid levels in the inlet flow cooling system area and in the return flow cooling system area. As a result, colder cooling liquid can again flow through the check valve until pressure equilibrium is obtained.

This process—heating up, evaporating, discharging liquid into the expansion tank, subsequent flowing out of the system—is cyclical and thrust-like rather than uniform and continuous. The process ends as soon as the bearing of the turbosupercharger has reached the cooling liquid boiling temperature. This is sufficient to prevent the oil in the bearing from coking. The normal thermosiphon action can then be employed.

Additional characteristics of the invention are illustrated in the following description taken together with the accompanying drawings.

BRIEF DRAWING DESCRIPTION

In FIGS. 1–5 of the drawings, the invention and its function are illustrated in an exemplary embodiment, without being limited to this embodiment.

FIG. 1 shows a schematic illustration of a liquid cooling system in accordance with the invention, and FIG. 2, 3, 4 and 5 show corresponding illustrations of the cooling system under various operation conditions.

DETAILED DESCRIPTION

Figure 1:
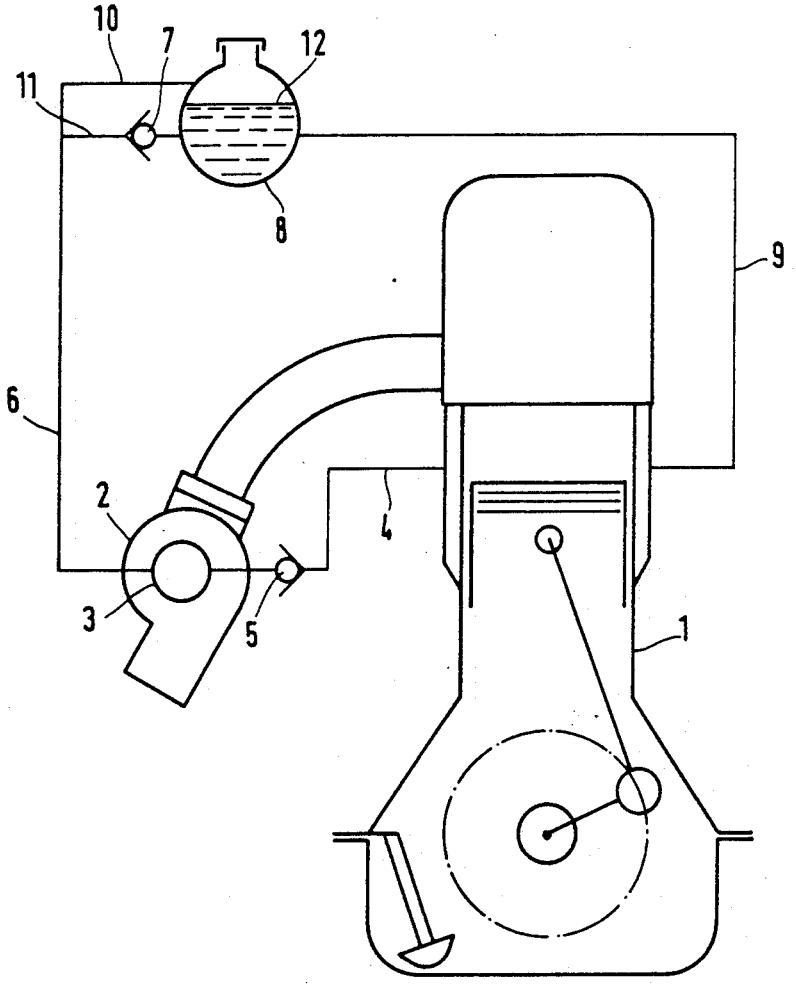

Referring now to the drawings in detail, FIG. 1 illustrates the structure of the liquid cooling system according to the invention. A turbosupercharger 2, which has a water-cooled bearing housing 3, is attached to an internal combustion engine 1. This turbosupercharger is connected to the cooling system of the internal combustion engine 1 with an inlet flow pipe 4 and a return flow pipe 6.

The engine cooling system is illustrated in a simplified manner; an inlet flow pipe 9 leads to the corresponding cooling elements of the internal combustion engine 1 while the return flow pipe of the internal combustion engine simultaneously comprises the inlet flow pipe 4 of the turbosupercharger 2 in the simplified illustration according to FIG. 1.

The inlet flow pipe 4 contains a check valve 5 which only allows flow through the inlet flow pipe 4 in a direction from the internal combustion engine 1 to the turbosupercharger 2. The return flow pipe 6 is divided into a first pipe 10 flowing into an expansion tank 8 above the cooling liquid level 12 and a second pipe 11 flowing into the expansion tank 8 below the cooling liquid level 12. The second pipe 11 has a check valve which only allows flow through the return flow pipe 6 in a direction from the turbosupercharger 2 to the expansion tank 8.

Figure 2:
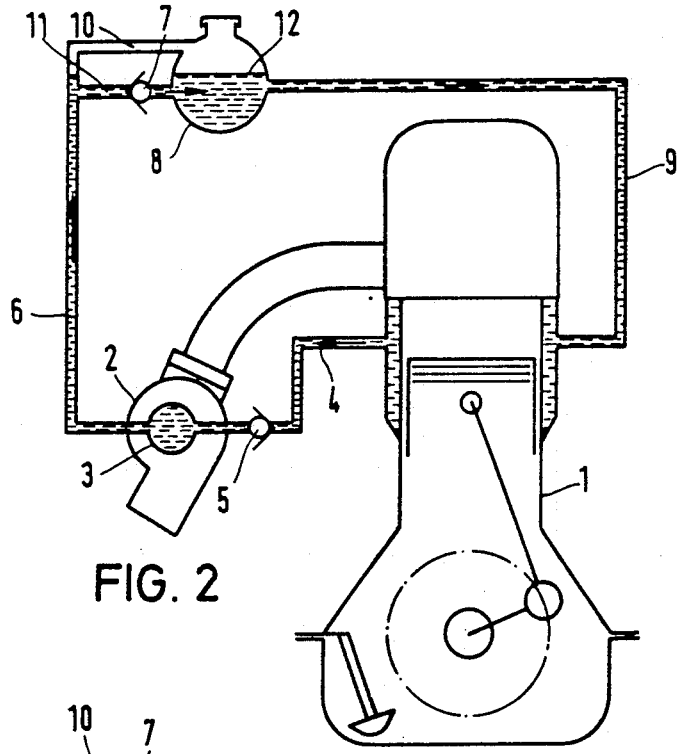

During normal operation of the internal combustion engine 1, as illustrated in FIG. 2, the cooling liquid, which is usually understood to be cooling water, is fed by a water pump (not shown in detail) in the circuit, through the inlet flow pipe 9 of the internal combustion engine 1 through the corresponding cooling elements of the internal combustion engine 1 to the inlet flow pipe 4 of the turbosupercharger 2. From there, the cooling water passes through the bearing housing 3 of the turbosupercharger 2 for the purpose of cooling the bearing of the turbosupercharger 2. Finally, the cooling water flows back into the expansion tank 8 from the turbosupercharger 2 through the return flow pipe 6 and the second pipe 11 and, again, into the inlet flow pipe 9 of the internal combustion engine 1.

The pump which feeds the cooling liquid is appropriately arranged in the inlet flow pipe 9 of the internal combustion engine 1. Moreover, the cooling circuit contains the actual radiator for the cooling liquid, which is likewise appropriately connected to the inlet flow pipe 9 of the internal combustion engine 1. The water pump and the radiator are not illustrated because the operation of the liquid cooling system in accordance with the intention is viewed with respect to the cooling intended after the internal combustion engine 1 has been switched off, i.e., with respect to an operation condition of the liquid cooling system in which the pump and radiator are out of operation, rather than with respect to the normal operation of the internal combustion engine 1.

Figure 3:
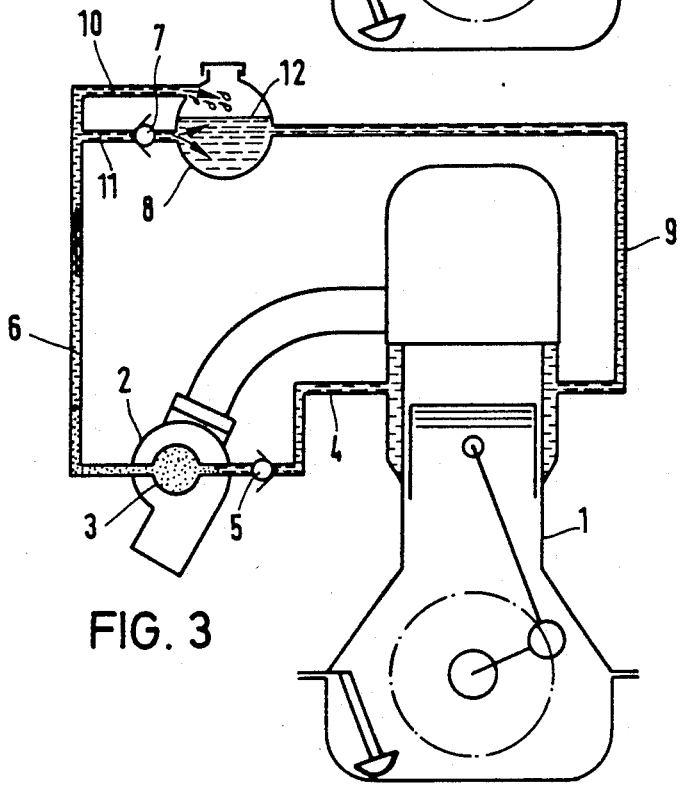

In an internal combustion engine 1 that has been switched off, the forced circulation of the cooling water is interrupted, and the remaining heat of the turbosupercharger 2 heats the cooling liquid in the bearing housing 3 up to the boiling point. As can be seen from the illustration in FIG. 3, vapor is thereby produced in the bearing housing 3. This vapor, which is produced suddenly, forces the water in the return flow pipe 6 before itself and both through the first pipe 10 and through the second pipe 11 into the expansion tank 8. The requirement for this is that the pipe cross section of the return flow pipe 6 is made small enough such that it enables the vapor to force before itself the cooling liquid columns in the return flow pipe 6 as well as the two pipes 10 and 11. The check valve 5 in the inlet flow pipe 4 of the turbosupercharger 2 prevents water or vapor from directly flowing back from the turbosupercharger 2 to the internal combustion engine 1.

Figure 4:
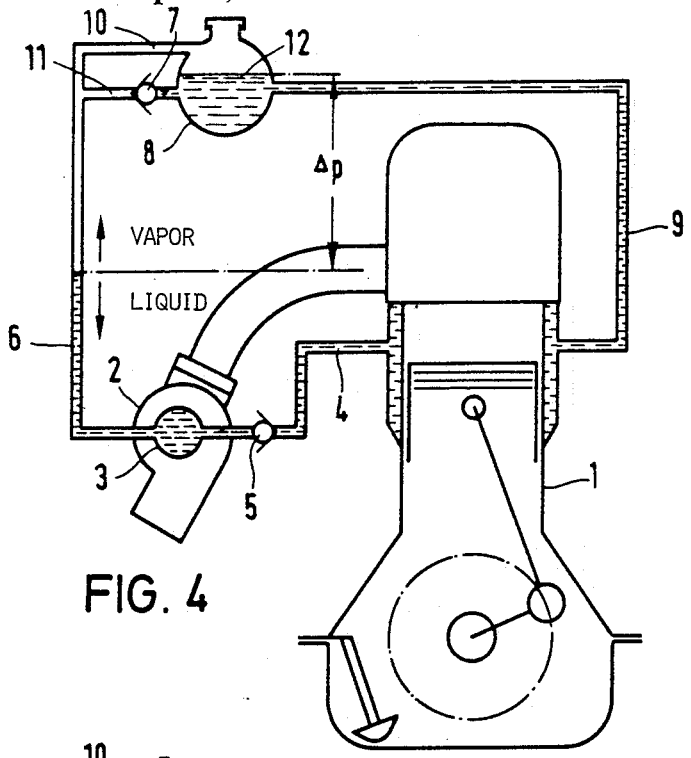
Figure 5:
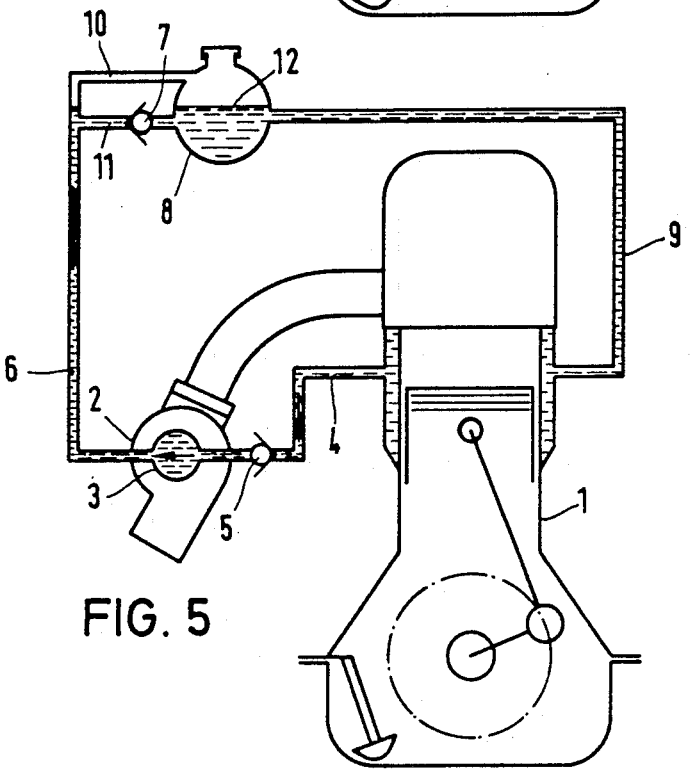

Subsequently, the water remaining in the return flow pipe 6 that is not forced into the expansion tank 8 flows back to the turbosupercharger 2, or it condenses the vapor in the return flow pipe 6. As is evident from the illustration in FIG. 4, a water level of the return flow pipe 6 results, which is lower by the amount of cooling liquid already fed into the expansion tank 8, since this amount cannot flow back either through the first pipe 10 ending above the cooling liquid level 12 or through the second pipe 11 ending below the cooling liquid level 12 due to the check valve 7. Thus, as shown in FIG. 4, a pressure difference p is produced, due to the difference in height of the water columns, at the check valve 5. Due to this pressure difference, fresh cooling liquid subsequently flows through the inlet flow pipe 4 past the check valve 5 until pressure equilibrium is obtained. This condition is shown in FIG. 5.

The process—heating up, evaporating, discharging water into the expansion tank 8, subsequent flowing out of the system—is cyclical and thrust-like rather than uniform and continuous. The process ends as soon as the bearing housing 3 has reached the cooling liquid boiling temperature.

While the invention has been described by reference to a preferred embodiment, it should be understood that numerous changes could be made within the spirit and scope of the inventive concepts described. Accordingly it is intended that the invention not be limited to the disclosed embodiment, but that it have the full scope permitted by the language of the following claims.

The embodiments of the invention in which an exclusive property or privilege is claimed are defined as follows:

1. A liquid cooling system for an internal combustion engine having a cooling circuit arranged for forced circulation cooling during engine operation, a turbosupercharger for charging the engine and connected to the engine cooling circuit via an inlet flow pipe and a return flow pipe, and an expansion tank for cooling liquid in the cooling system in which the cooling circuit is adapted to contain a predetermined amount of liquid so as to define a desired cooling liquid level in the expansion tank, characterized in that the inlet flow pipe (4) of the turbosupercharger (2) contains a check valve (5) and a return flow pipe (6) of the turbosupercharger (2) connects with a first branch pipe (10) flowing into the expansion tank (8) above the cooling liquid level (12) and a second branch pipe (11) flowing into the expansion tank (8) below the cooling liquid level (12) and containing a check valve (7).

2. A liquid cooling system according to claim 1, characterized in that the internal combustion engine (1) has an inlet flow pipe (9) and a return flow pipe, in which the inlet flow pipe (9) is connected to the expansion tank (8) below the cooling liquid level (12) and the engine return flow pipe comprises the inlet flow pipe (4) of the turbosupercharger (2).

* * * * *